United States Patent [19]

Wech

[11] Patent Number: 4,881,933

[45] Date of Patent: Nov. 21, 1989

[54] DRAW TAPE BAG FORMING METHOD AND APPARATUS

[75] Inventor: Robert J. Wech, Green Bay, Wis.

[73] Assignee: Amplas, Inc., Green Bay, Wis.

[21] Appl. No.: 158,418

[22] Filed: Feb. 22, 1988

[51] Int. Cl.[4] ..... B31B 1/90

[52] U.S. Cl. ..... 493/225; 493/192; 493/197; 493/202; 493/928

[58] Field of Search ..... 493/196, 197, 201, 202, 493/194, 225, 928, 191, 192

[56] References Cited

U.S. PATENT DOCUMENTS

| | | | |
|---|---|---|---|
| 3,058,402 | 10/1962 | Kugler | 493/196 |
| 3,148,598 | 9/1964 | Davis | 493/194 |
| 3,512,456 | 5/1970 | Meyer . | |
| 3,772,968 | 11/1973 | Ruda | 493/224 |
| 4,597,750 | 7/1986 | Boyd et al. | 493/225 |
| 4,624,654 | 11/1986 | Boyd et al. | 493/225 |
| 4,664,649 | 5/1987 | Johnson et al. | 493/197 |
| 4,714,455 | 12/1987 | Herrington | 493/196 |

*Primary Examiner*—Frederick R. Schmidt

*Assistant Examiner*—Robert Showalter

*Attorney, Agent, or Firm*—Andrus, Sceales, Starke & Sawall

[57] ABSTRACT

A draw tape bag is formed from a plastic web. An edge folding unit, a notching unit, a tape inserting unit, a heat sealing unit and a web folding unit form a compact continuous line in a rectangular path. The hem folder includes a L-shaped plate within the hem to receive a draw tape. The plate is pivotally mounted the tape within the hem. A wheel is rotatably and pivotally mounted for pulling the hem onto the plate. A single strap on a roll has a width equal to both tapes. The roll is driven and the strap passes over a knife to sever the strap from the tapes. A tension control roll is coupled to moving the strap and controls the strap feed to hold a constant tape tension. A folding board includes spaced edge channels in a V-shape for folding the flat web. An air layer is interposed between the web and the folding channels to provide a low friction movement. A bag making machine includes a presealer to form tape edge seals, a cooler for cooling the tape hems and an edge sealer and cutting unit to form the side edges of the bag.

27 Claims, 4 Drawing Sheets

DRAW TAPE BAG FORMING METHOD AND APPARATUS

BACKGROUND OF THE PRESENT INVENTION

The present invention is directed to a method and apparatus for making a draw tape bag and particularly to a draw tape bag formed of a plastic bag material and having a plastic draw tape in the open end for closing the bag.

Draw string bags have been produced for many years in which a cloth or plastic bag member is formed with an upper encircling hem having oppositely extendable draw strings secured within the hem for closing of the bag. More recently, draw tape bags have been provided including a plastic bag having an upper hem portion. Plastic tape members are located within the hem portion and exposed through openings in the hem to provide a corresponding draw tape bag structure. For example, U.S. Pat. No. 3,772,968 which issued Nov. 20, 1973 discloses a draw tape bag in which a pair of offset draw tapes are located within the common hem. The draw tapes are exposed to the opposite sides of the bag with each exposed draw tape sealed to the bag on a diagrammetrically opposite side. Pulling on the draw tapes thus provides for collapsing of the bag opening.

U.S. Pat. No. 4,624,654 which issued Nov. 25, 1986 discloses a draw tape bag formed from a continuous web which is folded on itself to form the opposite sides of the bag. The aligned free edges are folded inwardly on themselves to form a hem structure. The hems are edges notched at locations corresponding to the sides of the bag between sealed side edges. A draw tape is continuously fed into the open hems, with the inner edges of the hem subsequently heat sealed to complete the hem with the draw tape secured therein. The web is then sealed in longitudinally spaced transverse areas to define heat sealed sides of the bag. The web is severed along the side seals to separate the individual bags. Although such system provides a method of mass producing of such draw tapes bags, the hem portions of the folded web are located in overlapping relationship. The sealing of the edges to form the seam require special apparatus and machinery to prevent sealing of the hems to each other in the closing of the open hems of the bag. Generally, a barrier device is employed to maintain the hems separated from each other during the formation of the bag. The above '654 patent discloses a particularly form of a strip member interposed between the hems during the edges sealing. A similar method of forming a bag is disclosed in U.S. Pat. No. 4,664,649 which issued on May 12, 1987. In this patent, a special barrier is again interposed between the hems during the hems sealing to isolate and separate the hems from each other.

SUMMARY OF THE PRESENT INVENTION

The present invention is particularly directed to a method and apparatus of forming a bag from a plastic web wherein the hem structures are completely formed and with the tape applied into the hems of a plastic web member prior to the folding of the bag to form the opposite sides of the bag. Generally, in accordance with the present invention, a web member is fed through a forming apparatus with the opposite edges of the web located to the opposite sides of the apparatus and processed to form taped hems with the web folded in the center of the web. The hems are similarly and separately formed.

In accordance with one aspect of the invention, the edge folding unit, a notching unit, a tape inserting unit, a heat sealing unit and a web folding unit are mounted on a continuous line through which the web moves in a continuous flow. The several units are mounted in a substantially encircling and perferably rectangular flow path to establish a compact hem forming apparatus. In a preferred apparatus, each hem is formed by folding of the opposite edges of a flat web onto itself to define the hem portions. The hem folder includes similiar edge folding plate units laterally spaced in alignment with the web edge portions and joined by a single guide roller to support the web between the edge folders. The open hems are notched at appropriately spaced locations corresponding to the center of the side wall of each bag. A similar tape is then fed into each open hem from a common source. Each tape is directed laterally into alignment with the corresponding hem and fed directly into the hem portion by a suitable appropriate turning and aligning plate unit. The tape member can be formed as a very accurate essentially constant width and is somewhat smaller then the width or depth of the hem. It is important that the tape be accurately located within the hem. In a practical application, the continuous webs may tend to drift slightly as the result of normal force characteristics on the web. In accordance with the present invention, the turning plate unit for directing of the web into the hem are provided with a suitable on-line adjustable mount. The tape can then be accurately located within the hem with fine adjustment made while the machine is in operation for accurate depositing the tape within the hem area. The tape turning plate unit may be constructed with a pivot mounting of a turning plate for accurate alignment of the tape within the hem. The turning plate unit further includes, in another feature of the invention for optimum forming, a hem holding device for stretching and holding the hem web onto the turning plate for insertion of the tape.

The hem holding device in a preferred embodiment includes a wheel rotatably mounted on a pivot arm and biased, preferably by gravity, into engagement with the turning plate. The arm is also mounted for transversely pulling on the hem wall, as by a pivotal mounting of the arm for angular orientation of the wheel with respect to the path of the hem web. The wheel establishes a tightening force on the folded hem wall. In a practical construction, a bracket pivotally secures the outer end of the arm to a mounting slide. A pivot adjusting unit is secured to the slide and is coupled to pivot the mounting bracket and thereby the arm about the pivot unit. The bracket pivot unit controls the angular orientation of the mounting bracket, wheel arm and wheel with respect to the plate and the hem of the web. The angular orientation of the wheel controls the side pulling force asserted on the hem wall while the pivot arm adjustment screw varies the force applied by the wheel. The adjustment permits vary accurate adjustment of the forces on the hem wall to ensure holding of the web in a taut condition overlying the turning plate for receiving of the draw tape. The hem tightness control contributes significantly to the reliable and accurate placement of the tape within the hem and particularly contributes to the effective flow of the web through the hem forming unit.

The combination of the adjustable location of the plate slot within the hem and the adjustable hem wall holding wheel unit thus contributes to and establishes a particularly accurate location of the hem and tape and it passes from the tape insertion unit into the hem sealing unit. This aspect of the invention therefore has significantly contributed to the production of high quality draw tape bags without sacrifice and in fact contributing to continued high speed processing of the web.

In a preferred construction of the present invention, the tape for the two hems is provided from a common source of a single integral strap having a width corresponding to twice the width of each tape. The common strap is provided practically as a roll with the strap fed from the supply, which is preferably motor driven, through a severing device which severs the tape longitudinally and defines the two separate tapes which move continuously from the severing device to the opposite sides of the machine. A tension control device is coupled to the moving strap to monitor the strap tension and controls the feeding of the strap to establish and maintain a constant tension in the tapes within the hem forming apparatus. The individual formed tapes are fed through directing roll means and the adjustable turning plate units and deposited into the opposite hems of the web.

The taped hems and web then moves to a hem sealing station having a pair of laterally spaced sealing units, each of which is adjustably and accurately aligned with the inner edges of the hem. The sealing units are preferably suitable heating devices which form a continuous heat sealed seam inwardly from the folded free edge of the web hem wall to seal the free edge to the adjacent bag wall and thereby defining the seam with the tape freely movable therein.

A folding table or board unit is provided downstream of the hem sealer. The folding board unit includes spaced edge members constructed and connected to establish a V-shaped configuration and provide a continuous folding of the flat web with the hems in aligned relationship. To avoid the interference with the folding operation, in accordance with further aspect and teaching of the invention, an air layer is interposed between the bag web and the folding edge members to provide a high speed, low friction movement of the web with a continuous and reliable V-shaped folding of the web with the hems moved into aligned relationship.

A side edge sealer and bag making apparatus is located downstream of the folding table to complete the forming of the draw tape bags. The bag making apparatus includes a presealer to seal the hems, a cooler for cooking the presealed hems and a final edge sealer and cutter unit to seal the web on a transverse area which is centrally severed to form the edges of two adjacent bags of the web.

The present invention with the special orientation of the units, the tape forming an inserting unit and the folding unit provides a high speed cost-effective apparatus for forming of draw tape bags with the draw tapes reliably and repeatably positioned within the hem structures.

BRIEF DESCRIPTION OF THE DRAWINGS

The drawings furnished herewith generally illustrate the best mode presently contemplated for the invention and are described hereinafter.

In the drawings.

DESCRIPTION OF THE ILLUSTRATED EMBODIMENT

Figures 1, 3, 4:
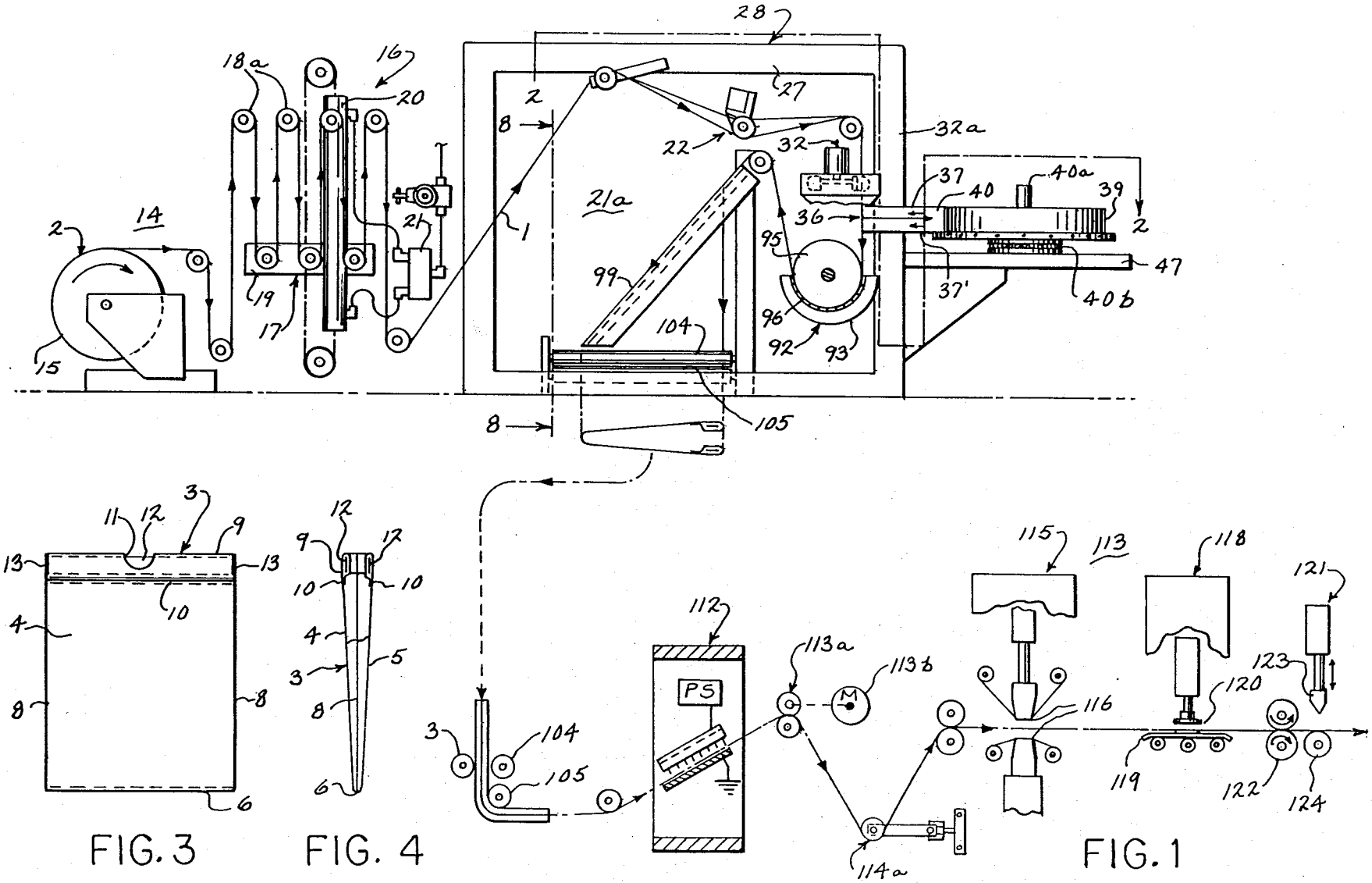
FIG. 1 is a simplified side view of a draw tape bag forming apparatus constructed in accordance with the teaching of the present invention.
FIG. 3 is a plan view of a draw tape bag.
FIG. 4 is a side view of the draw tape bag.
Figure 2:
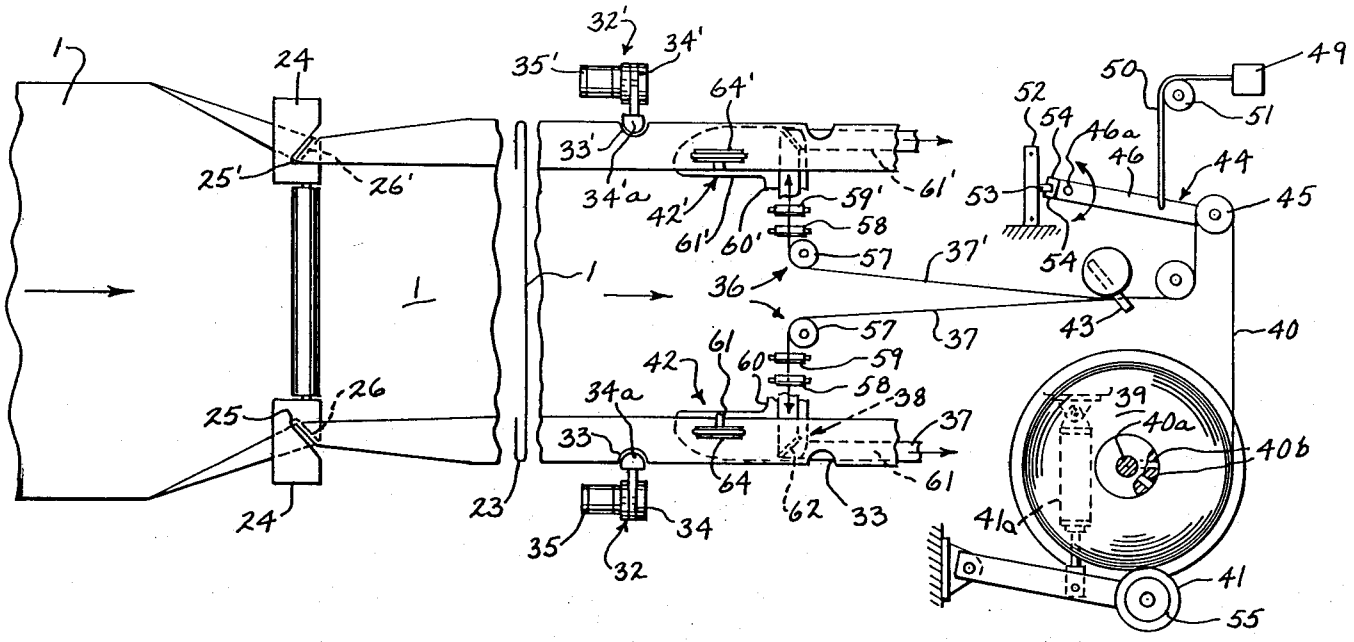
FIG. 2 is a plan elevational view of the draw tape bag forming apparatus shown in FIG. 1.

Referring to the drawings and particularly to FIGS. 1 and 2, a bag forming and making machine line is illustrated adapted to take a flat web 1 from a supply roll 2 and process the web through a plurality of spaced forming stations to form a series of draw tape bags 3. In accordance with well known general construction, the draw tape bag 3, as shown in FIG. 3, includes plastic sides walls 4 and 5 having an integral bottom edge 6. The side edges of the bag are formed by heat sealed edge seams 8. The top or open end of the bag 3 is formed with a hem 9 integral with each side wall, which is folded inwardly of the bag 3. A heat sealed seam 10 along the inner edge of each seam closes the hem to form a tubular portion. Each hem 9 has an opening or notch 11 centrally between the two side edge seams 8. A similar draw tape 12 is located in each hem 9 and is exposed through opening 11. The opposite ends of each draw tape 12 are correspondingly heat sealed to the bag sidewalls 4 and 5 and hem 9 by some what enlarged heat sealed edge seams 13. Pulling on the exposed draw tapes 12 results in closure of the draw tape bag 3.

Referring to the drawings and particularly to FIGS. 1 and 2, the apparatus includes an unwind station 14 including a suitable unwind stand 15 for rotatably supporting of the web supply roll 2. A single layer, flat web 1 is wound in roll 2. The web 1 has a width corresponding to the width of the bag sidewalls 4 and 5 and the integral hems 9. The unwind stand 14 is preferably a powered unwind stand for feeding of the web in a continuous and controlled manner into the machine line.

Draw rolls are provided in the downstream portions of the apparatus for continuously moving of the web 1 through the several bag forming stations.

A web accumulator unit 16 is mounted immediately downstream of the supply roll 2 and includes a dancer roll unit 17. The dancer roll unit 17 moves to absorb slack and to play out the web and thereby maintain a constant tension on the web 1 and a relatively predetermined taut condition as the web moves through the several stations of the machine.

The illustrated unit 17 includes vertically spaced rows 18 and **18*a* of idler rolls 19 with the web threaded between and through the rows of idler rolls. The idler rolls 18 and 18*a* are similarly supported on the opposite ends. The idler rolls 18 are carried by a common support 19. The common support 19 is vertically and reversibly movable in a direction to absorb any slack in the web and to remove any increased tension in the web. In the illustrated embodiment, a pair of pneumatic cylinder and cable units 20 are coupled, one each to each end of the support 19 of roll dancer unit 17. A regulated air supply 21 to the dancer cylinder units 20 supplies an adjustable uniform pressure to the cylinders and set a constant web tension in the web throughout a hem forming apparatus 21***a*.

The unwind unit 15 and the dancer roll unit 17 are generally known devices and no further description is given.

The flat web 1 is fed from the unit 16 into the hem forming apparatus 21*a* and particularly a hem folding unit 22 wherein the opposite edges of the web 1 are folded inwardly onto the main body of the web 1 to form an open hem having an inner wall 23 of the final hem 9. The unit 22 includes appropriately slotted turning plates 24 mounted in alignment with the incoming opposite web edges and guides the edge upwardly and laterally inwardly upon itself to form the inner wall 23. Each plate 24 is a slotted plate, (Fig. 2) with the web 1 moving through the slot 25 and over the slot wall 26 to form the hem wall. As shown in FIGS. 1 and 2, the opposite edges of the web 1 are similarly hemmed and the forming of one edge is described in detail. The corresponding unit for the other edge are identified by corresponding primed numbers.

In the illustrated embodiment, the hem folding unit 22 is mounted to the top frame portion 27 of a hem forming frame 28, with the web 1 moving upwardly and across the frame 27, with appropriate guide rolls 29 guiding the web into unit 22. The web 1 is discharged from the unit 22 over a guide roll 31 into a hem notcher unit 32.

The hem notcher unit 32 (shown rotated through 90 degrees in FIG. 2) is located immediately frame portion 32a of the hem forming apparatus. The notcher unit 32 is a timed device and is operable to periodically move through the outer edge portion of the folded hem wall 23 to form an edge opening 33 in the hem 9. The openings 33 and 33' in the opposite open hems 23 are aligned and equally spaced longitudinally along the web 1 in accordance with the width of bag 3 to locate openings 33 and 33' centrally of each bay side for defining the tape access openings 11 in the final bag 3.

The illustrated notcher unit 32 includes a rotating head 34 mounted in a supporting housing immediately adjacent and outboard of the open hem of the hem folded web 1. A semi-circular blade 34*a*, having a vertically oriented cutting edge, is secured to the head and is rotated through the hem 9. A stepper motor 35 is direct coupled to the head 31 and is operable to rotate the head in a periodic timed relation related directly to the speed of the web. With an appropriate constant speed of the web movement, a suitable timer, not shown, can be coupled to the motor and provide the desired time spaced actuation of the notching head 34 and blade 34*a* to provide the spaced notch openings 33.

Immediately downstream and below the notcher unit 32, a tape inserting unit 36 is provided and is specially constructed and oriented to insert continuous similar tapes 37 and 37' laterally into the open hems as at 38 in FIG. 2, with the web 1 moving vertically downwardly within the machine frame of the hem forming unit 21*a* as shown in FIGS. 1 and 2.

Generally, the tape inserting apparatus or unit 36 includes a common supply roll 39 having a draw tape strap 40 wound thereon. The roll 39 is rotatably mounted on a vertical spindle 40*a*. The roll 39 includes a central core 39*a* which rests on a needle bearing 40b for relatively free rotation of the supply roll 93. The needle bearing 40*b* has a lower hardened race resting on a horizontal base plate 47 and a top race with the core setting thereon. A motor-operated friction drive unit 41 is mounted to the machine frame and is biased into engagement with the peripheral face of the supply roll 39 by a pneumatic cylinder 41*a* to rotate the roll and unwind the strap 40 for insertion to a special turning and inserting plate unit 42. The supply roll 39 discharges a continuous strap 40 of indefinite length and of a width essentially precisely twice the width of each inserted tapes 37 or 37', and provides a common supply of both such tapes.

The inserting unit 36 includes a severing device such as at fixed knife 43, shown as a horizontally oriented knife precisely aligned with the center line of the strap 40 moving from the supply roll 39. The strap 40 is pulled over the knife 43 which serves to sever the strap into the distinct tapes 37 and 37' one for each side of the draw tape bag.

As most clearly shown in FIG. 2, a tension control unit 44 is coupled to the strap 40 to feed the tapes 37 and 37' to the hem inserting plate unit 42 under a controlled tension. The illustrated unit 44 includes a counter balanced roll 45 secured to the outer end of a pivot arm 46. A pivot unit 46*a* pivotally mounts the arm to the base plate 47 for supply roll 39. A counterweight element 49 is secured to the arm 46 adjacent the roll 45 by a cable 50 wound about a guide roll 51. A potentiometer 52 is mounted adjacent the pivot unit 46*a* and includes an input level 53. A pair of actuating tabs 54 project from the pivot arm 46 and serve to move the lever 53 on the potentiometer to produce a signal corresponding to the strap tension. The potentiometer 52 has its output connected to actuate the motor 55 of drive unit 41 for controlling the speed of motor 55 and the supply of strap 40 from the supply roll 39. The strap supply from roll 39 is varied to maintain a predetermined tension in tapes 37 and 37' for reliable and accurate insertion of the tapes.

The supply roll 39 is supported by a plurality of needle bearings 40*b* and provide an essentially free wheeling support of the strap supply roll 39. This provides a very free moving roll which has a highly sensitive response to the feeding of the strap for accurate tape insertion.

The free wheeling of the roll 39 would tend to continue rotation of the roll as a result of inertia forces during shut down of the system. A brake unit coupled to the motor, or dynamic braking of the motor, provides a slow down of the strap roll 39 during slow down and stopping of the machine apparatus, and thereby prevents the uncontrolled movement of the strap from the roll.

The two individual tapes 37 and 37' are turned laterally in opposite directions over spaced guide rolls 57 located downstream of knife 43. The laterally moving tapes 37 and 37' are threaded about a pair of aligning guide rolls 58 and 59 mounted as a part of the tape inserting plate unit 42 and 42', aligned with the corresponding upen hems of the web 1. The plate unit 42 includes a turning plate 61 aligned with and located within each hem 9 for inserting tapes 37 and 37' into the corresponding opened hem 9. The plate 61 includes an integral lateral extension member 60 defining a mounting portion for mounting of the plate 61 to the machine frame.

Figures 5, 6:
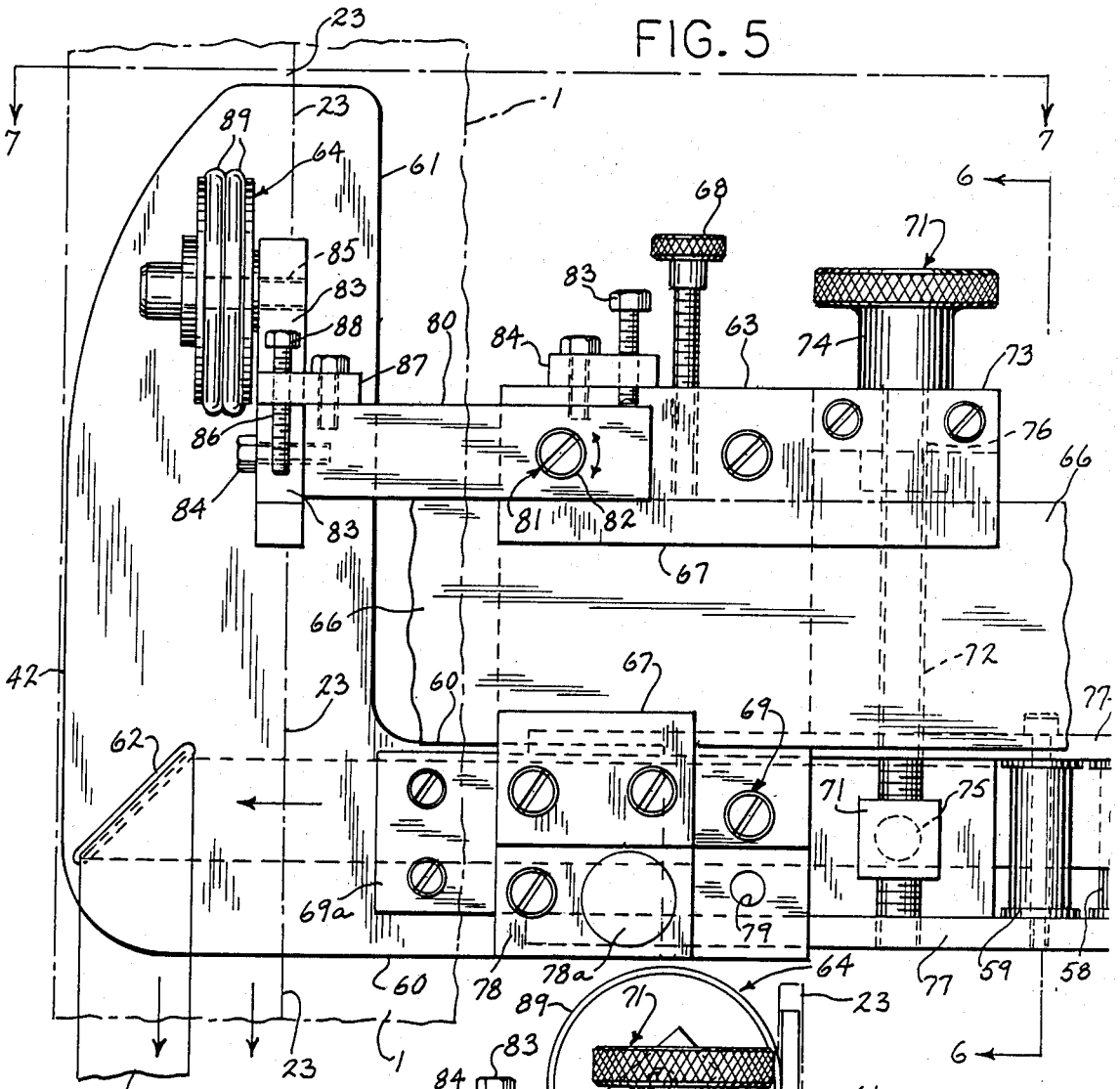
FIG. 5 is a plan view of the draw tape turning apparatus for incorporation into the draw tape bag machinery shown in FIGS. 1 and 2.
FIG. 6 is a sectional view taken generally on line 6—6 of FIG. 5 and illustrating the adjustable mounting of the draw tape turning apparatus shown in FIGS. 1–2.

The turning plate 61 is a flat plate member having an angled slot 62 at 45 degrees to the junction of plate 61 and mounting portion 60, and thus at 45 degrees to the direction of movement of the open hem 9 and the incoming tape 37. The tape 37 passes laterally into and through the slot 62 and over the 45 degree edge. The tape 37, which is withdrawn from the tape supply roll moving laterally of the machine and the web path, enters the slot and is turned ninety degrees into alignment with the open hem 9. In moving through the slot 62, the tape 37 is also turned to move in the direction of and with the moving web 1 for continuous movement therewith as shown in FIGS. 2 and 5. Thus, in the initial threading and set up of the machine, the tape is fed into the hem and moves with the hem. The slotted plate 61 is formed as a rigid supporting plate having smooth, low friction surfaces so as to turn the tape 37 smoothly and with minimal retarding forces and thereby promote the continuous smooth and flat movement of the tape 37.

Figure 7:
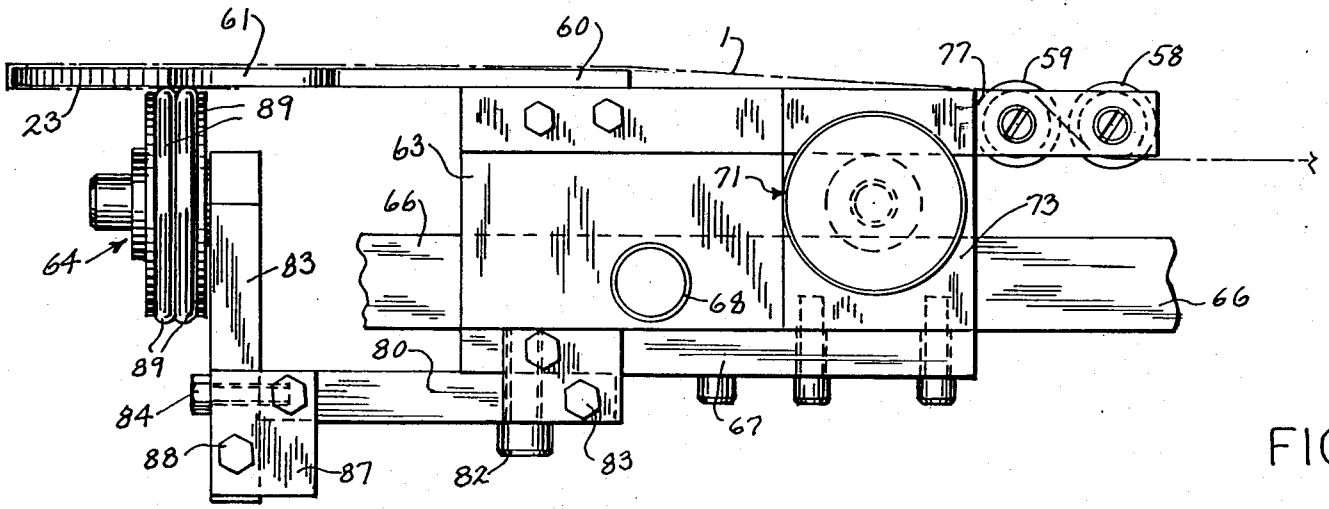
FIG. 7 is a vertical section taken generally on line 7—7 of FIG. 5 and illustrating further detail of the tape inserting apparatus.

In the illustrated embodiment, the turning plate 61 is a generally L-shaped member including the lateral mounting member or portion 60 secured to a mounting slide unit 63, as shown in FIGS. 5–7 and described as follows. The plate 61 is an elongated plate and extends from the turning slot 62 in the direction opposite to the incoming web 1 movement and thus away from the tape 37. A special hold down wheel or roller 64 is mounted in alignment with the folded hem. The roller 64 engages the folded wall 23 of the hem 9 and draws the hem walls tightly around the plate. The roller 64 prevents formation of wrinkles in the web 1 within the hem.

The alignment of the tape 37 within the hem is of substantial significance and the alignment will of course vary with the width of web 1. As illustrated, the tape 37 is of a slightly lesser width than that of the open hem 9. The tape 37 is particularly located slightly off-center and outwardly of the adjacent outer edge of the hem to provide maximum sealing area adjacent the inner edge portion of the folder web, for subsequent forming of the sealing hem seam 10, as hereinafter described.

Assuming initial precise alignment of the web 1, the movement of the web 1 through the machine may not always be precisely oriented in the same alignment. Further, during operation, the continuous movement of a web may result in slight lateral movement of the web. In the illustrated embodiment of the present invention, the turning plate 61 is pivotally mounted about an axis normal to the plate and permits alignment of the slot 62 within the hems during the running of the apparatus. The adjustment of the plate 61 provides a reliable and effective orientation of the tape 37 for proper forming of the hem seal 10 without welding of the tape 37 to the hem walls or the like.

More particularly and with reference to Figs. 3–5, the turning plate unit 42 is mounted to the side of the vertical machine frame in alignment with folded open hem 9 of the vertically moving web 1. The slide unit 63 includes a U-shaped slide 65 mounted on a crossbeam fixed to the machine frame. A pair of clamp plate 67 overly the open end of slide 65 and beam 66 to hold unit 63 on the beam. A locking screw unit 68 passes through one side of slide 65 to lock the turning plate 61 in place. The support slide 65 is positioned on the beam 66 to locate the turning slot 62 within the path of hem 9.

The turning plate 61 is pivotally mounted to the slide unit 65 for accurate placement of the turning slot 62 within the hem, as follows.

The plate mounting member 60 is secured to the lower slide wall by a pivot pin 69.

The plate 61 is secured to the outer end of the pivot pin 69 abutting a spacer element **69*a* to locate the plate in spaced relation to the slide unit 63 and providing a gap or passageway through which the open folded hem passes over the outer edge portion of the plate 61. The position of the plate 61 is controlled by an adjustment unit 70 coupled to the outer end of the mounting member 60. The illustrated adjustment unit includes a threaded follower member r71 secured to the plate member 60 and threaded into an adjustment threaded rod 72. In the illustrated embodiment of the invention, the threaded rod 72 has its upper end journaled in the upper wall of the slide 65. A separate adjustment block 73 is secured in side-by-side relation to the top wall of the slide by the slide clamping plate 67 secured to the slide and block. The threaded rod 72 projects downwardly past the beam 66 and is threaded into the follower member 71. The upper end of the rod projects outwardly with a knob 74 affixed thereto. The rod is locked against axial movement in the upper block and rotation of the rod therefore causes the follower member to move axially on the rod 72 with a corresponding pivoting of the plate 61. The plate 61 is connected to the member 71 by a pin 75 locked within a slot 76 in the plate. The rod 72 is journaled in the upper plate with significant tolerance to accommodate the pivotal movement of the plate 61 and member 60 with the linear movement of the rod 72 and the follower member 71 on the rod. The rod and follower are provided with appropriate accurately formed threads for precise and accurate adjustment of the locating plate 61 and the interconnecting turning slot 62** within the open hem.

The incoming guide rolls 58 and 59 of the tape inserting unit 42 are secured to the end of the mounting plate portion 60 essentially aligned with the slot 72. In the illustrated embodiment of the invention, mounting bars 77 are secured to the top and bottom edges of the plate mounting member 60. The bars 77 project outwardly, with the guide rolls 58 and 59 rotatably mounted therein. The tape 37 is threaded through the rolls 58 and 59 exiting along the back or exterior side of the mounting member 60. The rolls 58 and 59 are mounted essentially in alignment with slot 62 and the tape 37 moves outwardly from the rolls 58 and 59 into the slot, where the tape is turned downwardly for movement into and with the hem.

The two tapes 37 and 37' are vertically offset as they move from the cutting knife and turned laterally for insertion into the opposite open hems on the opposite edges of web 1. In accordance with a preferred construction of the present invention, an offset aligned block 78 is secured to the bottom wall of the slide and affixed thereto by a clamping bolt 78a. The block 78 includes a pivot hole 79 to which the plate 61' is pivotally coupled to offset the tape rolls 58' and 59' and the slot 61' below the bottom wall of the slide. This provides for mounting of the turning plate 61' offset by the offset of the tape 37' and permits the use of a standard assembly to the opposite sides of the machine. Thus, in the assembly for tape 37', the securement of the pivot block 78 to the turning plate unit merely lowers the plate, the slot 62' and rolls 58' and 59' into alignment with the lower tape.

Both turning plate units provide the same turning action, with the tapes 37 and 37' moving from the vertical orientation through the rolls, along the back or exterior side of the mounting portion of the L-shaped turning plate. Tapes 37 and 37' pass through the aligned slot 62 and then turns downwardly into open hem, moving with the hem into the heat sealing unit.

In operation, the threaded rod 72 is manually positioned to appropriately orient and locate the slot 62 within the moving open hem 9. The adjustment can be made with the web 1 and tape 37 flowing through the apparatus. This allows accurate and precise location of tape 37*n* within the hem 9 and in particular in spaced relation to the outer edge portion of the folded hem wall to establish and maintain the desired and appropriate sealing area.

As shown in FIGS. 5 and 6, the wheel 64 of the unit 42 is mounted in vertical orientation and is gravity biased into engagement with the web hem layer 23 passing over plate 61 and the slot 62. The wheel 64 is pivotally mounted for angular orientation with respect to the path of the hem 9 on plate 61 and applies a tightening force to the folded hem wall 23. In particular, mounting bracket 80 is pivotally secured as by a pivot pin unit 81 to the upper end of the slide 65. The pivot unit 81 includes a pivot pin 82 extending through the mounting bracket 80 into the slide, with the mounting bracket 80 projecting outwardly of the pivot pin. A pivot adjusting screw 83 is threaded into a small plate 84 secured to the sidewall of the slide 65 in alignment with the outward extension of the mounting bracket 80. The screw 83 is threaded inwardly into coupling engagement with the mounting bracket 80. The angular orientation of the mounting bracket 80 about the pivot pin 82 pivots wheel 64 with respect to the hem path and hem wall 23 and controls the lateral force applied to the folded hem wall for corresponding controlled positioning of the hem 9 about the plate 61.

The wheel 64 is secured to the outer end of the mounting bracket 80, as follows. A wheel level arm 83*a* is pivotally secured as by a pivot pin unit 84*a* to the outer end of the bracket 80. The arm 83*a* extends outwardly in opposite directions from the pivot pin unit 84*a*. The wheel 64 is rotatably mounted by a suitable shaft and bearing unit 85 to the outer upper end of the arm 83*a* and is gravity biased into engagement with the guide plate 61 and in particular the overlying folded hem wall. The opposite end of the arm 83*a* extends in the opposite direction downwardly of the pivot pin unit 84*a*. An adjustment unit 86 is secured to the mounting bracket 80 and includes a support adjustment plate 87 secured to the side wall of the bracket. An adjustment stop pin 88 is threaded into and through the bracket 80 with the outer end moving into bearing engagement with the top edge 89 of the lever arm 83*a*. The adjustable pin 88 forms a stop engaging the lever arm against the gravity force of the arm 83*a* and wheel 64. The stop pin 88 limits the movement of the lever and wheel 64 against the plate 61 and controls the frictional forces generated by the wheel 64 on the web. The angular orientation of the wheel 64 controls the angular pulling force asserted on the hem wall while the stop pin 88 varies the force applied by the wheel. The engaging face of wheel 64 includes a pair of rubber-like O-rings 89 for frictional engagement on the plastic web hem. The wheel adjustment permits accurate adjustment of the forces on the hem wall to ensure holding of the web in a taut condition overlying the turning plate 61 prior to its receiving of the draw tape 37. The end tightness control contributes significantly to the reliable and accurate placement of the tape within the hem and particularly contributes to the effective location for heat sealing of the hem seam in the continuous flow of the bag forming web through the hem forming unit.

The combination of the adjustable location of the slot 62 within the hem 9 and the adjustable hem wall holding wheel unit 64 contributes to and establishes accurate location of the hem 9 and tape 37 as it passes from the tape insertion unit into a hem sealing unit 92. This aspect of the invention thus has significantly contributed to the production of high quality draw tape bags without sacrifice and in fact contributing to the continued high speed processing of the web.

The taped hem 9 moves downwardly from the tape inserting unit into the heat hem sealer unit 92.

The hem sealing unit 92 is located immediately downstream in general vertical alignment with the tape inserting unit 36. The hem sealer unit 92 includes a pair of laterally spaced heating units 93 aligned with the inner edge portion of the inwardly folded hem walls 23 of hems 9 inwardly of the tapes 37 and 37′ . In the illustrated embodiment of the invention, the hem taped web is drawn over a sealing drum 95 which causes the hem walls to collapse onto each other. The heating units 93 are each a semicircular hot air nozzle unit properly aligned with the hems in the seam area and particularly the seam to be formed. Hot air jets 96 are projected toward the drum 95 and thus onto the hem area causing the web 1 to fuse together and form the hem seals. For example, the hem sealer may be as shown in U.S. Pat. No. 4,664,649, and is commercially available from AMI, Inc. of Doraville, Ga. A particularly satisfatory heat sealer unit for joining of the hem seams is disclosed in appliant's co-pending application entitled "Multiple Seam Forming Apparatus For Continuously Running Web", and filed on even date herewith and assigned to a common assignee.

The web passes downwardly around the lower half of the sealing drum 95 and then upwardly over a guide roll 98 in inwardly spaced relation to the sealer and the other related components, as shown in FIG. 1. The hemmed web 1 passes over the upper roll 98 and downwardly over the folding board unit 99, which is located within the machine frame beneath the hem former unit. The sealed hem 9 is on the underside of the web 1 moving over the folding board unit 99. The folding board unit 99 folds the web 1 on a central line of the web, with the opposite sides folded downwardly and the sealed hems 9 facing inwardly toward each other.

Figure 8:
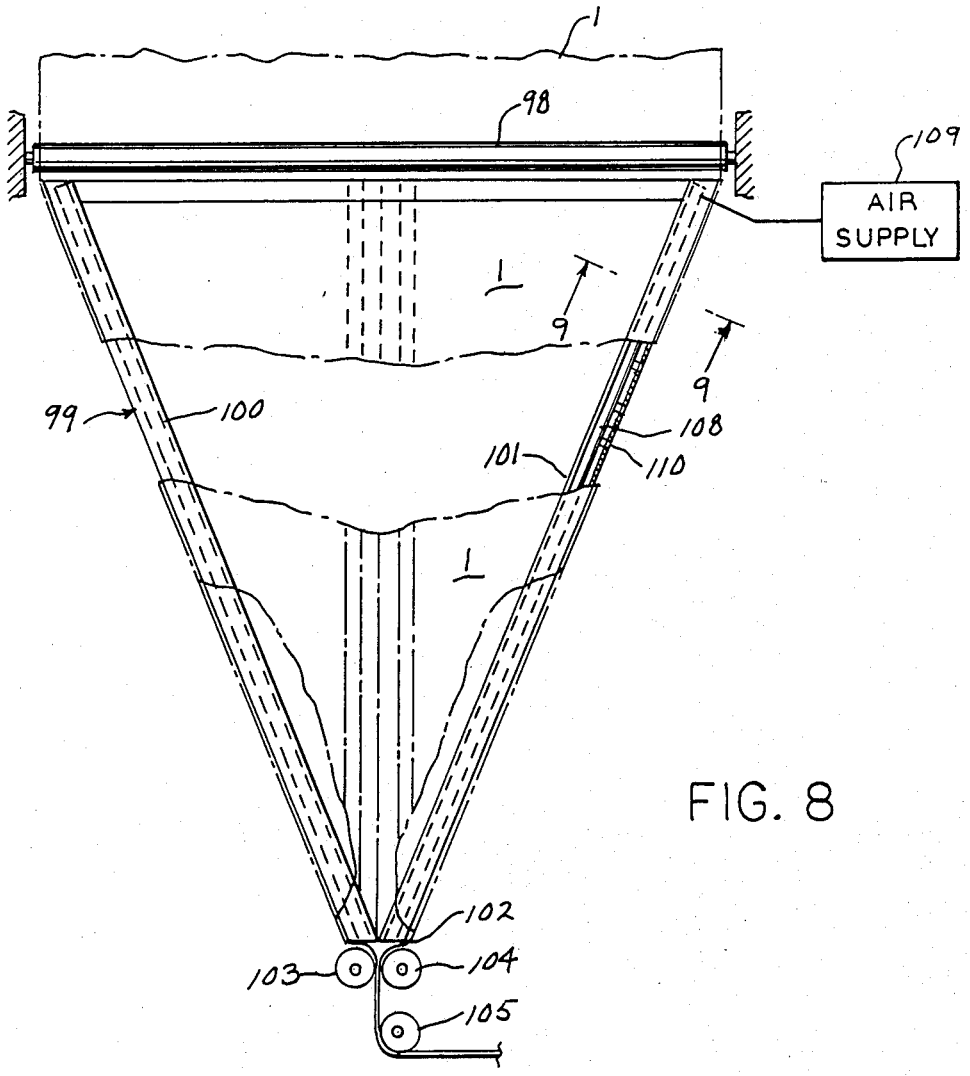
FIG. 8 is a plan view of the folding table unit shown in simplified form in FIGS. 1 and 2.
Figure 9:
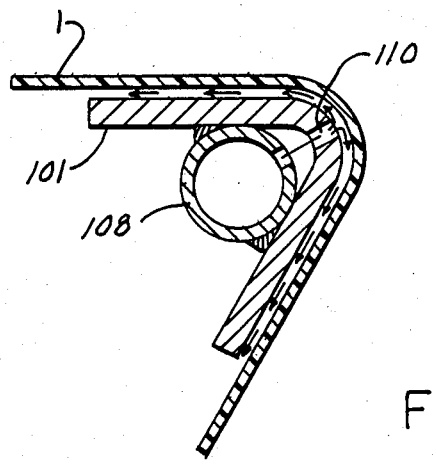
FIG. 9 is a vertical section taken generally on line 9—9 of FIG. 8 through the folding table.

The folding board unit 99, as clearly shown in FIGS. 8 and 9, is an open frame assembly. A pair of side frames 100 and 101 of the V-shaped folding board are similar L-shaped channel members. The side frames 100 and 101 are mounted in a V-shape, with the apex 102 of the "V" located adjacent the lower end of the machine frame structure. The L-shaped channel members 100 and 101 project upwardly and laterally from each other and form at generally equilateral triangle. The upper ends of channel members 100 and 101 are connected by a cross member is spaced aligned relation adjacent the top guide roll 98 which guides the hemmed web from the hem sealer unit 92 upwardly onto the upper end of the folding board unit 99. The open web folds into a V-shaped configuration on the side frames 100 and 101 and moves vertically downwardly therefrom with the opposite sides of the web passing through a pair of guide rolls 103 and 104 rotatably mounted to the lower end of the board unit 99. The guide rolls 103 and 104 extend beneath the board formed by the side members 100 and 101 and extend from the apex 102 centrally beneath the table. The rolls 103 and 104 are spaced from each other with a gap slightly greater than the thickness of the folded web. The opposite sides of the folded web 1 are aligned with the pass through the guide rolls 103 and 104 to effect the folding function.

The folded web is withdrawn from the guide rolls 103 and 104 transversely of the folding board unit 99 and the hem folding apparatus. A discharge roll 105 is mounted immediately beneath the two guide rolls with its periphery essentially tangent to the center of the gap between the guide rolls 103 and 104. The folded web then continuously moves from the hem forming and folding apparatus into the bag making machine as a folded web with the hems located in aligned superimposed relation.

In the illustrated embodiment of the invention, the hemmed web 1 passes upwardly over the reverse guide roll 98 and then downwardly over folding board unit 99 which is generally an open V-shaped unit, the center line of which is accurately aligned with the center line of the hemmed web 1. Thus, as the web 1 moves down over the board, the flat web 8 changes from the flat configuration to the V-shaped configuration with sidewalls and hems 9 in aligned overlying relation. Although, folding boards of this type are known in web forming devices and are commercially available, the illustrated table 99 is specially formed as follows. Similar air supply tubes 107 and 108 are located within the frames 100 and 101 respectively and connected to a suitable pressurized air supply unit 109. The supply tubes and the channel edges have aligned openings 110 which generate an air flow 111 projected into and beneath the folding web 1 and the channel walls. The air 110 moves outwardly and establishes a low friction support surface which produces a continued smooth movement of the web, with a smooth folding of the web over the table unit 99. It is important that the folding operation maintains the opposite sides of the web 1 in a smooth continuous flow to avoid wrinkling and the like and thereby produce an acceptable finished draw tape bag.

The low friction also significantly contributes to maintaining the appropriate web tension. The variation in the loading of the web is minimized and the accumulator unit 16 readily responds to any slight change to maintain continued smooth flow of the web through the apparatus.

The sealed hem 9 in the folded web should be a flat, double layered web for subsequent processing. As more fully developed in the copending application of David Stock, entitled "Pliable Tube Collapsing Apparatus", filed on even date herewith and assigned to a common assignee herewith, a static generator unit 112 is located immediately downstream of the folding apparatus. Unit 112 includes a commercially available static electric field generator aligned with the aligned hems 9. The static generator unit 112 induces a controlled charge of static electricity within the multiple plies of the hem channels and tape, and insures complete collapse of the hem walls. The hems are thereby positively flattened for movement of the folded web through a bag making machine 113. A nip roll drive unit **113*a* is coupled to the web. The drive unit 113*a* is continuously driven by a suitable motor drive 113*b*. A web tension control unit 114, similar to the control unit 44, is located between the generator unit 112 and the bag making machine 113 to accommodate the continuous and uninterrupted web flow in the hem forming unit 21*a* and the intermittent stepped flow through machine 113. The control unit 114 includes a potentiometer controlling the nip roll drive unit 113*a***.

The bag making machine 113 includes a hem presealer unit 115 for initially sealing of the web in the area of the hems 9 at spaced longitudinal locations corresponding to the side edges and seams 8 and 13 of the draw tape bag 1. The presealer unit 115 includes a pair of opposed sealing shoes 116 slightly less than the depth of the aligned hems 9 such that the inner edge of the shoe is spaced outwardly of seam 10. The width of the shoes 116 is greater than the width of the final edge seam 10 in the bag 1 to form the enlarged heat sealed seam 13 at the tapes 37 and 37'. The edge of seam 13 is thereby spaced outwardly of the hem seal 10 and creates an opening between the seam 13 and seal 10 to prevent possible forming of a bubble in the hem upstream of the draw rolls 122. The folded web 1 moves through the presealer unit 115 with an intermittent web movement, in accordance with conventional bag making operations. The sealing shoes 116 move across the hems 9 and seal the hem walls and the tapes to firmly affix the ends of the tapes 37 and 37' to the sides of the bag 3. The presealer unit 115 is actuated in appropriate timed relation to the stepped movement of the web which is produced in accordance with known machine controls.

A seal cooler unit 118 is mounted immediately downstream of the presealer unit 115. The cooler unit 118 includes a cooling plate 119 underlying the web 1 and a reciprocated pressure plate 120. The plate 120 forces the preseal area to the cooling plate 119 and cools the presealed hem prior to the sealing and severing of other folded web 10 to form the individual draw tape bags 3. The cooling is desirable to minimize the possibility of the preseal sticking other portions of the bag orother bags during subsequent operation.

From the cooler unit 118, the formed and presealed web 1 is fed into the sealing and severing unit 121, which is diagramatically illustrated. The severing unit may be anyone of various commercially available devices. Generally, a pair of start-stop draw rolls 122 are mounted at the infeed side of the severing unit. The draw rolls 122 are operated in timed relation intermittently to draw the folded web through the line including the hem forming unit **21*a* and the bag making machine 113. The preseal area is precisely centered with a thermal seal and cutoff knife 123 and an anvil 124. The sealing and cutoff knife 123 is actuated to form the side edge seam 8** and sever the seamed web along the complete width of the web on the center of the seam to complete formation of the draw tape bag.

The severed and complete draw tape bags are then transferred into a final processing system, not shown, such as a bag folding and/or stacking apparatus, not shown.

Various modes of carrying out the invention are contemplated as being within the scope of the following claims particularly pointing out and distinctly claiming the subject matter of the invention.

1. A compact draw tape bag forming apparatus for forming bag members from a single integral plastic sheet folded along a longitudinal line to define two adjoining bag side walls which are joined along longitudinally spaced portions to define an open-top bag and wherein each of the free edges of said bag are folded inwardly to form a sealed hem with a draw tape therein, the improvement in the forming apparatus comprising, a hem forming unit forming a double wall open hem in each edge of said web and of a depth corresponding to said hems, a tape inserting unit located downstream of said hem forming unit for inserting individual tapes into said hems, a heat sealing unit located downstream of said inserting unit and having means to simultaneously and continuously seal the inwardly folded web onto the web to form hems with said tapes therein, a web folding unit board means located downstream of said heat sealing means for folding said web along a center line of the web, means supporting said hem forming unit, said tape inserting unit, said heating sealing unit and said folding units in a generally encircling vertical path, wherein said hem folding unit is secured to the top of said path, said web moving from a first vertical side upwardly and horizontally from a web source to said hem forming unit, a notching unit for forming notches in each of said hems, said notching unit and said tape inserting unit located to the discharge side of said hem folding unit and in a vertical portion of said path, means for turning of said web from said hem forming unit into said notching unit, said tape inserting unit having means for inserting individual tapes into said open hems, said heat sealing unit located beneath said inserting unit, said web folding unit located generally in alignment beneath said hem folding unit, and means turning said web from said heat sealing unit into said web folding unit.

2. The draw tape bag forming apparatus of claim 1, including a bag making unit including means to receive said folded web from said folding unit, a presealer to thermally seal the walls of said hem and said tape to each other to form a tape seal, a cooler aligned with said tape seal, and a thermal sealing and severing unit aligned with said web and having sealing and severing means extended across the path of said web and producing a transverse thermal edge seal across said web in alignment with and superimposed on said tape seal and to sever the web essentially centrally of said thermal edge seal, and means to periodically move said folded web with a step movement through said bag making unit.

3. The apparatus of claim 2, including an accumulator connected upstream of said bag making unit and forming a storage unit for storing the folded web during the step movement of the web through the bag making unit.

4. The apparatus of claim 1, wherein said tape inserting unit includes a support means projecting laterally outwardly of the path of the web for receiving a tape strap roll on which an indefinite length of strap is wound, said tape strap having a width equal to twice the width of each of said tapes, means for feeding of said strap from said roll, a severing means aligned with the center of said strap and operable to sever said strap into a pair of essentially identical tapes, a guide plate unit having means for guiding said tapes into said hems, and a tension control means coupled to said strap and to said means for feeding said strap and operable to maintain a constant tension in said tapes as the tapes move into said hems.

5. The apparatus of claim 4, wherein said folding unit includes a V-shaped folding board means having a pair of side frame members connected to define the edges of a V-shaped table having a bottom apex aligned with the center of the hemmed web and having the web moving along the V-shaped table to a folded relationship, means for introducing air between the side frame members and the web to reduce the friction between the web and the board for maintaining a smooth continuous movement of the web through the apparatus.

6. The apparatus of claim 5 including a bag making machine aligned with said folding means and including means for forming longitudinally spaced thermal seams in said folded web and for severing the web along said thermal seams, and roll guide means for guiding said folded web into said bag making machine.

7. A compact draw tape bag forming apparatus for forming a bag member from a single integral plastic sheet folded along a longitudinal line to define two adjoining bag side walls which are joined along longitudinally spaced portions to define an open-top bag and wherein each of the free edges of said bag are folded inwardly to form a sealed hem with a draw tape therein, the improvement in the forming apparatus comprising, a hem forming unit forming a double wall open hem in each edge of said web and of a depth corresponding to said hems, a notching unit form forming a notch in the edge of said open hems, a tape inserting unit located downstream of said hem forming unit for inserting individual tapes into said hems, heat sealing unit located downstream of said inserting unit and having means to simultaneously and continuously seal the inwardly folded web onto the web to form hems with said tapes therein, a web folding unit board means located downstream of said heat sealing means for folding said web along a center line of the web, means supporting said hem forming unit, said notching unit, said tape inserting unit, said heating sealing unit and said folding succeeding planar including at least first and second succeeding planar paths substantially perpendicular to each other and having at least one of said units in said first plane and at least one other unit in said second plane, wherein said path includes a third planar pathincluding said folding unit in said third planar path, and said hem folding unit secured in said first plane.

8. The apparatus of claim 7 wherein said second path is a vertical path including said tape inserting unit and said heat sealing unit.

9. The apparatus of claim 7 wherein said notching unit and said tape inserting unit are located to the discharge side of said hem folding unit and in said second plane, means for turning of said web from said hem forming unit into said notching unit, said tape inserting unit having means for inserting individual tapes into said open hems, said heat sealing unit located beneath said tape inserting unit.

10. A compact draw tape bag forming apparatus for forming draw tape bags from a single integral plastic sheet folded along a longitudinal line to define two adjoining bag side walls which are joined on longitudinally spaced transverse portions to define an open-top bag and wherein each of the free edges of said bag are folded inwardly to form a sealed hem with a draw tape therein, the improvement in the apparatus comprising, means for advancing a pliable web in a continuous uninterrupted movement, a hem forming unit folding the opposite edges inwardly upon the web to form a double wall open hem of a depth corresponding to said hems, said web moving in a generally horizontal plane through said hem forming unit, a tape inserting unit located immediately downstream of said hem forming unit and vertically offset therefrom, means for turning of said web from said hem forming unit into said tape inserting unit, said tapes into said hem, said web and tape moving in a continuous corresponding manner through said tape inserting unit, heat sealing means located in vertical alignment beneath said hem forming unit, means for feeding of said taped web into said heat sealing means, said heat sealing means having means to simultaneously and continuously seal the inwardly folded web onto the web to form a hem with said tape therein, and a web folding table means located downstream of said heat sealing means and horizontal offset therefrom and substantially in alignment beneath said hem forming unit, said web folding folding table means adapted to fold said web along a center line of the web with the inner hem layers located in abutting relation.

11. The apparatus of claim 10 including discharge means coupled to the folding web adjacent the lower end of the folding table means and withdrawing of said folded web from said folding table means and moving the folded web laterally of said folding table means.

12. The apparatus of claim 10, wherein said tape turning means includes a turning plate having a turning slot for said tape, said plate extending longitudinally of said slot in the direction opposite of the tape movement, and a hem wall tightening means drawing said hem tightly about said plate.

13. A draw tape bag forming apparatus for forming of bag members from a single integral plastic web folded along a longitudinal line to define two adjoining bag side walls which are joined along longitudinally spaced portions to define an open-top bag and wherein each of the top edges of said bag are folded inwardly and sealed to receive a draw tape, the improvement in the apparatus comprising:

means for advancing a flat single integral web as a continuous uninterrupted movement, a hem forming unit simultaneously folding the opposite edges inwardly upon themselves to form a double wall open hem of a depth correspond to said hems, a tape inserting unit located downstream of said hem forming unit, said tape inserting unit including a tape feed unit having a means for receiving a tape strap roll on which an indefinite length of strap is wound, said tape strap having a width equal to twice the width of each of said tapes, means for feeding of said strap from said roll, a severing member aligned with the center of said strap and operable to sever said strap into a pair of essentially identical tapes moving longitudinally of the web and between said edges, a tape turning device operable to turn said individual tapes laterally from each other in opposite directions and into lateral alignment with said open hems and including a tape turning means located between the walls of said double wall open hem, said tape passing through said turning means into said hem for depositing of the tape into said hem, and heat sealing means located downstream of said tape turning device, said heat sealing means having means to simultaneously and continuously seal the inwardly folded web to form a sealed hem with said tape freely movable therein.

14. The apparatus of claim 13, wherein said tape inserting unit includes a strap tension control unit coupled to said strap between said roll and said knife means to control the tension of said strap, and drive means coupled to said roll for continuously feeding of said strap from said roll into said tension control unit, and means to sense the tension in said strap and control the drive means to maintain a predetermined tension.

15. The apparatus of claim 13, including a web folding board means located downstream of said heat sealing means, said web folding board means being adapted to fold said web along a center line of the web with the inner hem layers located in abutting relation.

16. The apparatus of claim 15, including discharge means coupled to the folded web adjacent the lower end of the folding board means and withdrawing of said folded web from said folding table means and moving the folded web laterally of said folding board means.

17. The apparatus of claim 15, wherein said folding board means includes a pair of side frame members mounted in a generally V-shaped configuration having an apex aligned with the center of the hemmed web and having the web move downwardly over the side frames to a folded relationship at the lower end of the V-shaped member, means for introducing air between said side frames and the web to thereby reduce the friction forces between the web and the members for maintaining a smooth continuous movement of the web through the apparatus.

18. The apparatus of claim 17 wherein said members are generally L-shaped channels having one side aligned to form a planar surface and depending sides depending downwardly with the web moving over the edge joining the channel sides, the edge having spaced openings, and an air supply means coupled to insert air through the openings.

19. A draw tape bag forming apparatus for forming of a bag members from a single integral plastic sheet folded along a longitudinal line to define two adjoining bag side walls which are joined along longitudinally spaced portions to define an open-top bag and wherein each of the free edges of said bag are folded inwardly to form a hem and receive a draw tape, the improvement in the apparatus comprising:

unwind means for advancing a flat single ply web in a continuous uninterrupted movement, hem forming unit simultaneously folded the opposite edges inwardly upon the web to form a double wall open hem in the opposite edges of the web of a depth corresponding to said hems, a notching unit for forming edge notches in said open hem, a tape inserting unit located immediately downstream of said notching unit, said tape inserting unit having means for inserting individual tapes into said open hems and including a turning plate means projecting into each of said hems, said turning plate means having a turning slot for each of said hems directing said tape into alignment with said hem, means for pulling the web about said plate to locate the tape within the hem, said tape and web moving in a continuous manner through said inserting unit, heat sealing means located downstream of the tape inserting unit, means for feeding of said taped single ply web into said heat sealing means, said heat sealing means having means to simultaneously and continuously seal the inwardly folded web wall of the hem onto the web to form a sealed hem with said tape freely movable therein, and a web folding board means located downstream of said heat sealing means and folding said web along a center line of the web with the inner hem layers located in abutting relation.

20. The draw tape bag forming apparatus of claim 19, including a bag forming unit including means to receive said folded web, a hem presealer unit aligned with said overlying hems and operable to thermally seal the walls of said hems and said tapes to each other and forming a tape seal, a precooler unit aligned with said hems, and a thermal sealing and severing unit aligned with said web and having a sealing and severing means extending across the path of said web and producing a thermal seal across said web and to sever the web essentially centrally of said thermal seal, and means to periodically move said folded web through said presealer unit, said precooler unit and said thermal sealing and severing unit with said tape seal sequentially aligned with said presealer unit, said precooler unit and said sealing and severing means.

21. The apparatus of claim 19, including an accumulator connected to said unwind and including a fixed roll unit and a dancer roll unit for maintaining a fixed tension in said web, said accumulator including a pneumatic cylinder and cable unit connected to said fixed roll unit and said dancer roll unit.

22. A method of forming draw tape bags from a continuous length of a single ply pliable bag web moving as a single ply flat web in a continuous uninterrupted flow through a machine, comprising the steps of folding the longitudinal free side edges of said web inwardly to define a longitudinally extending open hem on each edge, forming longitudinally spaced openings in the edges of said hem wall and web to expose a subsequently inserted tape, feeding a single tape strap having a width corresponding to approximately double the width of said tape, said strap being continuously and uninterruptedly advanced over a severing means to sever said strap into a pair of corresponding hems tapes said strap being located generally centrally of the web, oppositely turning of said individual tapes laterally outwardly with a first of said tape moving into alignment with a first of said hems with a second of said tapes moving into alignment with a second of said hems and turning of said tapes within said open hems to insert the tape between each web and corresponding hem wall, joining the hem walls of said web to said web along the inner edge of each hem walls to form continuous hems with said continuous tapes freely located within said hems, and folding of said web on the center of said web after said joining of the hem walls and with the web and hems folded inwardly toward each other into adjacent abutting engagement, and severing the pliable folded web along longitudinally spaced intervals along the length of the folded web to separate individual bag members from the continuous web.

23. The method of claim 22, wherein said web is fed as a continuously moving web through each of said steps to the severing step, said severing step including moving said folded web in an intermittent sequence through a sealing and severing means and transversely sealing and severing of the web to form said individual bag members.

24. The method of claim 22, wherein said openings are formed at regular intervals corresponding to the essential center point between the severing locations of the web material.

25. The method of claim 22, wherein said tape inserting step includes placing a separate turning plate within each of said open hems and pivoting the turning plates laterally of the web to accurately locate the tape within the hem walls with the web and tapes being continuously and uninterruptedly advanced through said step of inserting said tape, and applying a pulling force on said web passing over said plates and drawing said web over said plates.

26. The method of claim 22 including the step of forming a tape preseal in alignment with said tape and extending along the aligned hems of the bag member of each of said spaced intervals.

27. The method of claim 27, including the step of cooling said tape present and thereafter transversely sealing and severing of the web.

* * * * *

UNITED STATES PATENT AND TRADEMARK OFFICE

CERTIFICATE OF CORRECTION

PATENT NO. : 4,881,933

DATED : November 21, 1989

INVENTOR(S) : Robert J. Wech

It is certified that error appears in the above-identified patent and that said Letters Patent is hereby corrected as shown below:

Col. 14, line 22, delete "form" and substitute therefor ---for--- Col. 14, line 35, after "folding" insert ---units in a non-planar path---; Col. 14, line 35, delete "succeeding planar"; Col. 14, line 40, delete "pathincluding" and substitute therefor ---path including---; Col. 15, line 4, after said insert "tape inserting unit having means for inserting individual "; Col. 15, line 4, delete "hem" and substitute therefor ---hems---; Col. 15, line 16 delete "folding" (second occurance); Col. 16, line 36, delete "a" (first occurance); Col. 16, line 45, delete "folded" and substitute therefor ---folding---; Col. 17, line 37, delete "hems" and substitute therefor ---hem---; Col. 18, line 39, delete "27" and substitute therefor ---26--- ; Col. 18, line 40, delete "present" and substitute therefor ---preseal---.

Signed and Sealed this

Thirtieth Day of July, 1991

*Attest:*

*Attesting Officer*

HARRY F. MANBECK, JR.

*Commissioner of Patents and Trademarks*